US005272508A

United States Patent [19]

Sakakibara et al.

[11] Patent Number: 5,272,508

[45] Date of Patent: Dec. 21, 1993

[54] ELECTROPHOTOGRAPHIC PHOTOSENSITIVE MEMBER AND APPARATUS INCORPORATING THE SAME

[75] Inventors: Teigo Sakakibara, Tokyo; Kiyoshi Sakai, Chofu; Noriko Ohtani; Naoto Fujimura, both of Yokohama, all of Japan

[73] Assignee: Canon Kabushiki Kaisha, Tokyo, Japan

[21] Appl. No.: 598,153

[22] Filed: Oct. 16, 1990

[30] Foreign Application Priority Data

Oct. 19, 1989 [JP] Japan ..... 1-270332
Dec. 5, 1989 [JP] Japan ..... 1-314262

[51] Int. Cl.[5] ..... G03G 15/04

[52] U.S. Cl. ..... 355/229; 355/211; 430/58; 430/945

[58] Field of Search ..... 430/58, 60, 510, 945, 430/126; 355/246, 229, 211

[56] References Cited

U.S. PATENT DOCUMENTS 4,617,245 10/1986 Tanaka et al. ..... 430/58
4,618,552 10/1986 Tanaka et al. ..... 430/60
4,693,951 9/1987 Takasu et al. ..... 430/31

*Primary Examiner*—Marion E. McCamish
*Assistant Examiner*—S. Rosasco
*Attorney, Agent, or Firm*—Fitzpatrick, Cella, Harper & Scinto

[57] ABSTRACT

An electrophotographic photosensitive member comprises a drum-shaped or endless-sheet-shaped light-transmissive carrier made of a light-transmissive resin, at least one of the top and bottom surfaces of which has maximum and mean roughness both ranging from 0.3 μm to 4.0 μm, and a photosensitive layer is formed on one of the surfaces of the carrier. The photosensitive layer has a laminate structure composed of a charge generating layer and a charge transporting layer. A light-transmissive layer containing fine particles dispersed in a binder resin may be provided between the light-transmissive carrier and the photosensitive member. An electrophotographic apparatus incorporating this electrophotographic photosensitive member has an image exposure light source such as a laser or an LED array disposed at the side of the photosensitive member adjacent the carrier so as to apply an exposure light to the photosensitive member through the light-transmissive carrier. A facsimile apparatus incorporates this electrophotographic apparatus as a printer.

22 Claims, 4 Drawing Sheets

ELECTROPHOTOGRAPHIC PHOTOSENSITIVE MEMBER AND APPARATUS INCORPORATING THE SAME

BACKGROUND OF THE INVENTION

1. Field of the Invention

The present invention relates to an electrophotographic photosensitive member capable of preventing interference. The invention also relates to an electrophotographic apparatus incorporating the electrophotographic photosensitive member.

2. Description of the Related Art

In general, an electrophotographic process includes the steps of charging a photosensitive member, exposing the photosensitive member to an image so as to form an electrostatic latent image on the photosensitive member, and developing the latent image by a developer so as to make the image visible. This process is widely used in copying machines for producing copy images on ordinary paper sheets. Hitherto, several types of electrophotographic processes were known and used, such as an electro-fax process, a xerographic process and an NP-type process which is, for example, disclosed in Japanese Patent Publication No. 42-23910.

The electro-fax process and the xerographic process make use of the so-called "Carlson" process for forming an electrostatic latent image. More specifically, each of these two types of electrophotographic processes uses a photosensitive plate composed of a carrier sheet and a photoconductive layer of zinc oxide, OPC (organic photoconductor), amorphous selenium or amorphous silicon formed on the carrier sheet. The surface of the photosensitive plate is uniformly charged and is exposed to light from an original so as to attenuate the electrostatic charge in the regions irradiated with light, whereby an electrostatic latent image having a light or dark pattern corresponding to that of the original, is formed. The thus-formed electrostatic latent image is developed by charged colored particles so as to become a visible image, which image is then either fixed directly to the photosensitive member or, is fixed after transfer to another image carrying member, such as copy paper. In any event, a fixed electrophotographic image is obtained.

On the other hand, the NP-type process forms an electrostatic latent image by utilizing the photoconductivity of a photoconductive layer and also the difference in the electrostatic capacitance between the photoconductive layer and an insulating layer provided on the photosensitive layer. After the forming of the electrostatic image, the developing, the transfer and the fixing steps are sequentially executed to produce a fixed electrophotographic image, as in the case of the electro-fax and xerographic processes.

Various electrophotographic copying apparatuses making use of these electrophotographic processes have been developed and used.

In general, known electrophotographic apparatuses employ photosensitive members in the form of a cylinder or an endless loop of web with the photosensitive layer formed on its outer surface. Conventionally, charging and exposure are effected from the outer side of the photosensitive member. In recent years, however, apparatuses have been proposed which employ a photosensitive member having a light-transmissive carrier so as to enable the imagewise exposure to be performed from the inside of the carrier in order to attain a compact electrophotographic apparatus and to simplify the process. The exposure through the carrier of the photosensitive member is, for example, an imagewise exposure, pre-transfer exposure, pre-cleaning exposure or charge-removing exposure.

The pre-transfer exposure, pre-cleaning exposure and the charge-removing exposure are conducted in such a manner as to uniformly expose the entire area of the photosensitive member. Such exposure is effected by applying a light from a suitable light source, such as a fluorescent lamp, halogen lamp or a tungsten lamp, which is disposed inside the photosensitive member, through a slit which enables the light to reach only the region which requires the exposure. Alternatively, the exposure is conducted by using a laser light source or an LED array capable of illuminating only the region requiring the exposure. Thus, pre-transfer exposure, pre-cleaning exposure and charge-removing exposure can be conducted by light applied from the space inside the photosensitive member, without substantial difficulty.

In contrast, an image exposure from the space inside the photosensitive member encounters the following problem. When the copying apparatus is of the so-called analog copying apparatus type in which the photosensitive member receives light reflected from an original to be copied, a complicated and large-size arrangement is necessary for applying the reflected light to the photosensitive member from the space inside the photosensitive member. In this type of electrophotographic apparatus, therefore, it is quite meaningless to conduct the imagewise exposure from the interior of the photosensitive member. For this reason, the imagewise exposure from the interior of the photosensitive member is applicable only to apparatus of the digital type, in which a laser or an LED light source array is applied digitally in accordance with a digital signal obtained by electrically processing the image.

However, the imagewise exposure with a digitally controlled light source from the interior of the electrophotographic member suffers from the following problem. Since the laser light or the LED light source produces monochromatic light, interference rings caused by reflecting light beams within the member are inevitably formed in the photoelectric photosensitive member or at the surface of the carrier adjacent the photosensitive layer, with the result that an irregular potential distribution is developed on the electrophotographic photosensitive member. This irregular potential distribution is critical particularly in image exposure, since image defects, known as interference fringes or rings, are produced by such an irregular potential distribution.

In order to prevent production of such interference fringes, U.S. Pat. No. 4,617,245 proposes to make coarse the surface of a carrier of a photosensitive member, which is made of a light-non-transmissive material, such as a metal. Meanwhile, U.S. Pat. No. 4,618,552 proposes to provide a light diffusion layer between the light-non-transmissive carrier and the photosensitive layer. These proposals, however, are applicable only to electrophotographic apparatus of the type in which image exposure is conducted by applying light from the exterior of the photosensitive member. If such proposals are applied to the apparatus of the type which employs image exposure from the interior of the photosensitive member, the copied image is undesirably disturbed because the light is scattered or diffused through the coarse surface of the carrier or the diffusion layer, with the result that the image quality is seriously degraded.

SUMMARY OF THE INVENTION

Accordingly, an object of the present invention is to provide an electrophotographic photosensitive member which is suitable for use in an electrophotographic apparatus of the type which applies a monochromatic light through the carrier of the photosensitive member and which is capable of providing an image of a high quality without substantial image defects.

Another object of the present invention is to provide an electrophotographic apparatus which incorporates the above-mentioned photosensitive member.

To this end, according to one aspect of the present invention, there is provided an electrophotographic photosensitive member comprising: a light-transmissive carrier at least one surface of which has a maximum roughness value ranging from about 0.3 μm to 4.0 μm and a mean roughness value ranging from about 0.3 μm to 4.0 μm; and a photosensitive layer formed on one surface of the carrier.

The invention also provides an electrophotographic photosensitive member comprising: a light-transmissive carrier; a photosensitive layer; and a light-transmissive layer formed between the light-transmissive carrier and the photosensitive layer, the light transmissive layer containing fine particles capable of randomly scattering monochromatic light to prevent formation of interference fringes on the photosensitive layer.

According to another aspect of this invention, there is provided an electrophotographic apparatus comprising: an electrophotographic photosensitive member having a light-transmissive carrier at least one surface of which has a maximum roughness value ranging from about 0.3 μm to 4.0 μm and a mean roughness value ranging from about 0.3 μm to 4.0 μm, and a photosensitive layer formed on one of the major surfaces of the carrier; and a monochromatic light source adjacent the light-transmissive carrier side of the electrophotographic photosensitive member; whereby monochromatic light passes through the light-transmissive carrier to illuminate the photosensitive layer.

According to yet another aspect of the invention, there is provided an electrophotographic apparatus comprising: an electrophotographic photosensitive member having a light-transmissive carrier, a photosensitive layer, and a light-transmissive layer formed between the light-transmissive carrier and the photosensitive layer, the light-transmissive layer containing fine particles capable of randomly scattering monochromatic light to prevent formation of interference fringes on the photosensitive layer; and a monochromatic light source adjacent the light-transmissive carrier side of the electrophotographic photosensitive member; whereby monochromatic light passes through the light transmissive carrier and the light-transmissive layer to illuminate the photosensitive layer.

According to an additional embodiment of the present invention, there is provided a facsimile apparatus comprising an electrophotographic apparatus with an electrophotographic photosensitive member having a light-transmissive carrier at least one surface of which has a maximum roughness value ranging from about 0.3 μm to 4.0 μm and a mean roughness value ranging from about 0.3 μm to 4.0 μm, and a photosensitive layer formed on a surface of the carrier, and a monochromatic light source adjacent the light-transmissive carrier side of the electrophotographic photosensitive member adjacent to the light-transmissive carrier; and receiving means for receiving picture data from a remote terminal and for converting the data to a control signal for operating the monochromatic light source.

According to a further embodiment of the present invention, there is provided a facsimile apparatus comprising: an electrophotographic apparatus including an electrophotographic photosensitive member having a light-tansmissive carrier, a photosensitive layer, a light-transmissive layer formed between the light-transmissive carrier and the photosensitive layer and containing fine particles, and a monochromatic light source adjacent the light-transmissive carrier side of the electrophotographic photosensitive member, whereby monochromatic light passes through the light transmissive carrier and the light-transmissive layer to illuminate the photosensitive layer; and a receiving means for receiving picture data from a remote terminal and for converting the data to a control signal for operating the monochromatic light source.

Since at least one surface of the carrier has been roughened such that maximum and mean roughness both range from 0.3 μm to 4.0 μm, with or without the light-transmissive intermediate layer, the electrophotographic photosensitive member of the present invention eliminates defects such as interference fringes, flaws, spots and fog, when used in an electrophotographic apparatus of the type in which the photosensitive layer is exposed to a monochromatic light from a light source through the light-transmissive carrier.

In addition, the electrophotographic photosensitive member of the invention enables the various apparatuses, such as copying machines and printers, to be of compact and light-weight construction, while assuring improved quality of the images.

DESCRIPTION OF THE PREFERRED EMBODIMENTS

Figure 1:
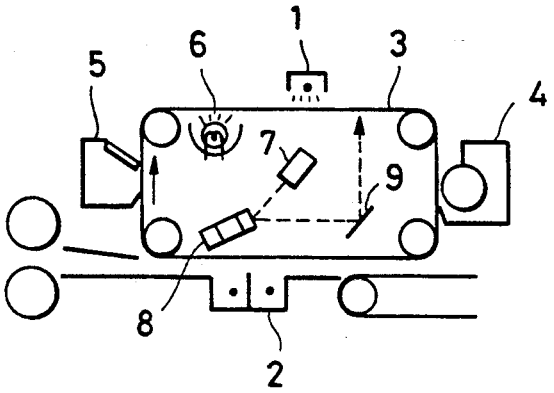
FIG. 1 is a sectional view of an embodiment of an electrophotographic apparatus of the present invention employing a laser as an image exposure light source.

In the electrophotographic photosensitive member of the present invention, at least one of the two major surfaces of the light-transmissive carrier carrying the photosensitive layer has a maximum value and a mean roughness value ($R_z$) both of which are not less than 0.3 μm and not more than 4.0 μm, preferably not less than 0.5 μm and not more than 3.0 μm, as measured by the 10-point mean roughness measuring method specified by JIS (Japanese Industrial Standards) B 0601.

According to the present invention, the photosensitive member having a carrier with a roughness specified above is charged and is then irradiated with a monochromatic light through the light-transmissive carrier, so that a latent image is formed on the photosensitive layer. The photosensitive member is then sequentially subjected to successive steps of development with toner, transfer, fixing, cleaning and charge-removing exposure. By using such a photosensitive member, it is possible to obtain a copied image of a high quality without substantial image defects.

According to the invention, the carrier supporting the photosensitive layer may be made from a suitable light-transmissive material such as a glass, a resin and the like. Preferred examples of the resin suitably used as the material of the carrier are PET (polyethylene terephthalate), PVDF (polyvinylidene fluoride), polyallylate, polysulfone, polyamide, acrylic resin, acrylonitrile resin, methacrylic resin, vinyl chloride resin, vinyl acetate resin, phenol resin, epoxy resin, polyester, alkyd resin, polycarbonate and polyurethane. It is also possible to use a copolymer resin which contains two or more repeating units of the above-mentioned resins, such as styrene-butadiene copolymer, styrene-acrylonitrile copolymer and styrene-maleic acid copolymer.

Preferably, the photosensitive member has a cylindrical form or a looped endless sheet-like form, which may be self-supporting or flexible.

The photosensitive member of the present invention is produced by roughening at least one major surface (top or bottom) of the carrier to a specified degree of roughness coarseness by means of a sand mat, sand paper or a type of a sheet impregnated with a grinding agent. More specifically, the roughening is effected to such a degree that both the maximum value and the mean value ($R_z$) of roughness are not less than 0.3 μm and not more than 4.0 μm, preferably not less than 0.5 μm and not more than 3.0 μm, as measured by the 10-point mean roughness measuring method specified by JIS (Japanese Industrial Standards) B 0601. If one or both of the maximum roughness and the mean roughness are below 0.3 μm, interference fringes are not completely extinguished so that defects are produced in the copied image. On the other hand, when one or both of the maximum and mean roughness values exceed 4.0 μm, defects, such as spots or flaws, are generated due to an excessive scattering of light. When one or both of the maximum and mean roughness values of the carrier surface adjacent the photosensitive layer exceed 4.0 μm, defects, such as spots or flaws, are caused due to an increase in the injection of charge carriers generated from the scattered light.

It will be recognized, of course, that the particular wavelength, the incident light and the particular thickness of the density of the applied image effect the roughness values to be employed. As the wavelength becomes shorter, the minimum roughness value will generally decrease and vice versa. As the thickness of the carrier decreases or the refractive index decreases, the maximum roughness values tend to increase and vice versa. Accordingly, depending on the ultimate use, it may be possible to utilize values somewhat less than 0.3 μm or greater than 4.0 μm.

It will also be recognized that if the actual light source differs from a purely monochromatic coherent source, the interference characteristics of the light source and light-transmissive carrier may also differ.

Further, it is noted that with a scanned laser light source, the required roughness will be seen to increase as the angle of incidence increases.

The carrier having one or both surfaces roughened as above is then subjected to a treatment for making the carrier surface for carrying the photosensitive layer conductive. This is done by forming a layer of a conductive substance by evaporation, deposition, sputtering, plasma CVD, or plating.

Examples of the preferred conductive substance are one or more selected from a group of metals consisting of Al, Au, Cu, Ag, Ni, Ti, Zn, Cr, In, Sn, Sn, Pb, Fe, mixtures thereof and so forth, alloys of these metals, metal oxides, such as ITO and $SnO_2$, alumite or the like, and substances obtained by doping such metals and metal oxides with a halogen element, such as chlorine or iodine.

This treatment also may be effected by coating the carrier surface for carrying the photosensitive layer with a conductive polymer.

The conductive layer thus formed preferably has a surface resistivity not higher than $10^9$ Ω·cm, more preferably not higher than $10^8$ Ω·cm.

In another form of the electrophotographic photosensitive member of the present invention, a light-transmissive layer is interposed between the carrier and the photosensitive layer of the photosensitive member. The light-transmissive layer contains fine material, such as resin particles or resin powder dispersed therein. The material of the light-transmissive layer may be a resin, but, if desired, other materials having a high light transmittance and a large refractive index can also be used. Although resin particles or powder of a resin powder can suitably be used as the fine material, fibrous or flake-shaped material may be dispersed in the transmissive layer in place of the particles or powder. A light-transmissive layer having a uniform light diffusion characteristic can easily be obtained provided that fines of uniform shape and size are evenly diffused in the light-transmissive layer.

When this type of photosensitive member is used in an electrophotographic apparatus of the type described, the monochromatic light applied through the carrier is reflected and scattered in a random manner by the fines dispersed in the light-transmissive layer, so that generation of interference fringes is materially eliminated.

The photosensitive layer is formed on the conductive surface of the carrier by, for example, forming a dispersion liquid by dispersing fine particles or powder of a suitable material in a suitable dispersing liquid or carrier and then applying the dispersion liquid to the conductive surface of the carrier. The material which is to be dispersed is typically a resin or an oligomer such as acrylic resin, styrene-acrylic resin, polystyrene, polyurethane, polyester, fluoro-hydrocarbon resin, polyamide or polymethylsylsesquioxane.

The mean particle size of the fine particles or powder of the above-mentioned resin or oligomer is usually 10 μm or smaller, preferably 3 μm or smaller, while the content of the fine particles or powder in the binder resin is 10 to 80 wt %, preferably 20 to 60 wt % based on the total weight of solids.

Image defects such as unevenness of the image density tend to occur when the mean particle size exceeds 10 μm. When the content of the fine particles or powder in the binder resin is 10 wt % or less, interference fringes are not completely extinguished, so that defects are undesirably produced in the image. When the content is 80 wt % or greater, the sensitivity is lowered due to a reduction in the light transmittance, and the film formability is extremely impaired allowing generation of image defects, such as spots and flaws, in the copied image.

Various known resins can be used as the resin of the light-transmissive layer. Preferred examples of such resins are a solvent-soluble polyamide, such as copolymer nylon, N-methoxymethylated nylon or the like, phenol resin, polyurethane, polyurea and polyester.

The thickness of the light-transmissive layer is preferably 0.1 to 150 μm, more preferably 1 to 50 μm.

According to the invention, the photosensitive layer may be a composite or laminated layer composed of a charge generating layer containing a charge generating substance and a charge transporting layer containing a charge transporting substance, or may be a single layer containing both the charge generating substance and the charge transporting substance. When the photosensitive layer has a laminated structure, the charge generating layer is formed by dispersing one of the charge generating substances shown below in a below-listed binder resin so as to form a dispersion liquid and applying this liquid to the conductive surface of the carrier or to the light-transmissive layer when such a layer is used. It is preferred that the photosensitive layer has an organic laminate structure. It is understood, of course, that other methods can be employed to form the laminated structure.

The following pigments can be used in the charge generating layer:

Azo pigments such as Sudan red, dian blue etc.

Quinone pigments such as pyrene quinone, anthanthrone, etc.

Quinocyanine pigments

Perylene pigments

Indigo pigments such as indigo, thioindigo etc.

Phthalocyanine pigments, such as copper phthalocyanine etc.

Examples of the binder resin suitably used are polyvinyl butyral, polystyrene, polyvinyl acetate, acrylic resin, polyvinyl pyrrolidone, ethyl cellulose, acetic-butyric cellulose, and so forth.

The thickness of the charge generating layer is generally 5 μm or less, preferably 0.05 to 2 μm.

The charge transporting layer on the charge generating layer can be formed by using a coating liquid prepared by dissolving or dispersing a charge transporting substance in a resin which has a film-formability as required. Examples of the charge transporting substances suitably used are a polycyclic aromatic compound with biphenylene, anthracene, pyrene or phenanthrene in its main or side chain, a nitrogen-containing heterocyclic compound such as indole, carbazole, oxadiazole or pyrazole, a hydrazone compound, a styryl compound, and so forth.

Examples of the resin having film-formability are polyester, polycarbonate, polymethacrylic acid ester, and polystyrene. The thickness of the charge transporting layer is usually 5 to 40 μm, preferably 10 to 30 μm.

The laminate type photosensitive layer may be constructed such that the charge generating layer overlies the charge transporting layer.

When the photosensitive layer is of the single-layered type, the charge generating substance and the charge transporting substance are both present in the resin or matrix.

The above-described construction and materials of the photosensitive layer are not exclusive, and the photosensitive layer may be an organic photoconductive polymer layer, such as a polyvinyl carbazole layer or polyvinyl anthracene layer, a selenium evaporated layer, a selenium-tellurium evaporated layer or an amorphous silicon layer.

It is possible to provide an under-coat or sub-layer having a barrier function and a bonding function, between the conductive layer and the photosensitive layer or between the light-transmissive layer and the photosensitive layer. Such an under-coat layer may be formed from, for example, casein, polyvinyl alcohol, nitrocellulose, ethylene-acrylic acid copolymer, alcohol soluble polyamide, polyurethane, gelatin or aluminum oxide. The thickness of the under-coat layer is generally 0.1 μm to 5 μm, preferably 0.5 μm to 3 μm.

Figure 2:
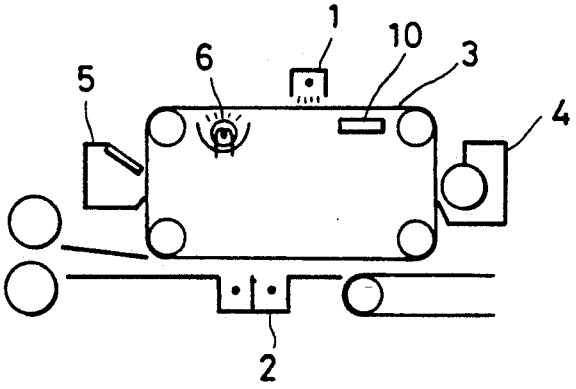
FIG. 2 is a sectional view of another embodiment of the electrophotographic apparatus employing an LED array as the light source.
Figure 3:
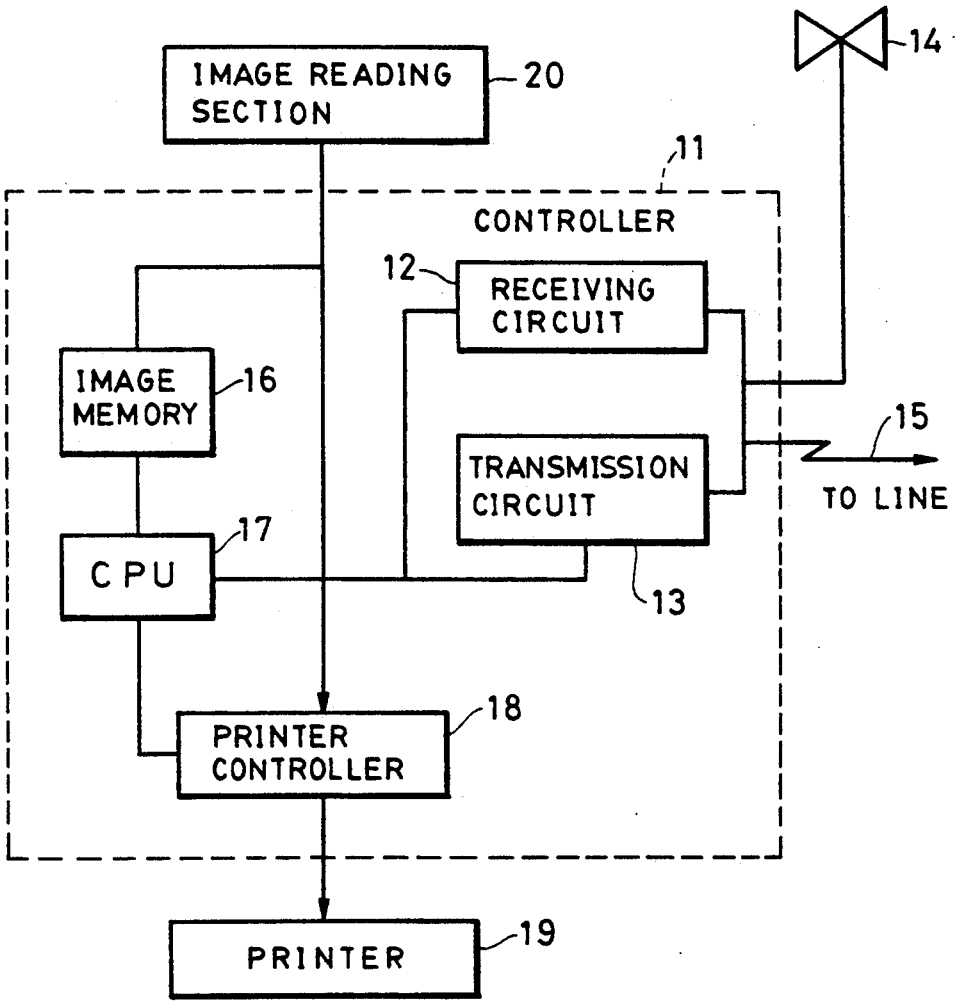
FIG. 3 is a block diagram of a facsimile system which employs an electrophotographic apparatus of the invention as a printer.
Figure 4:
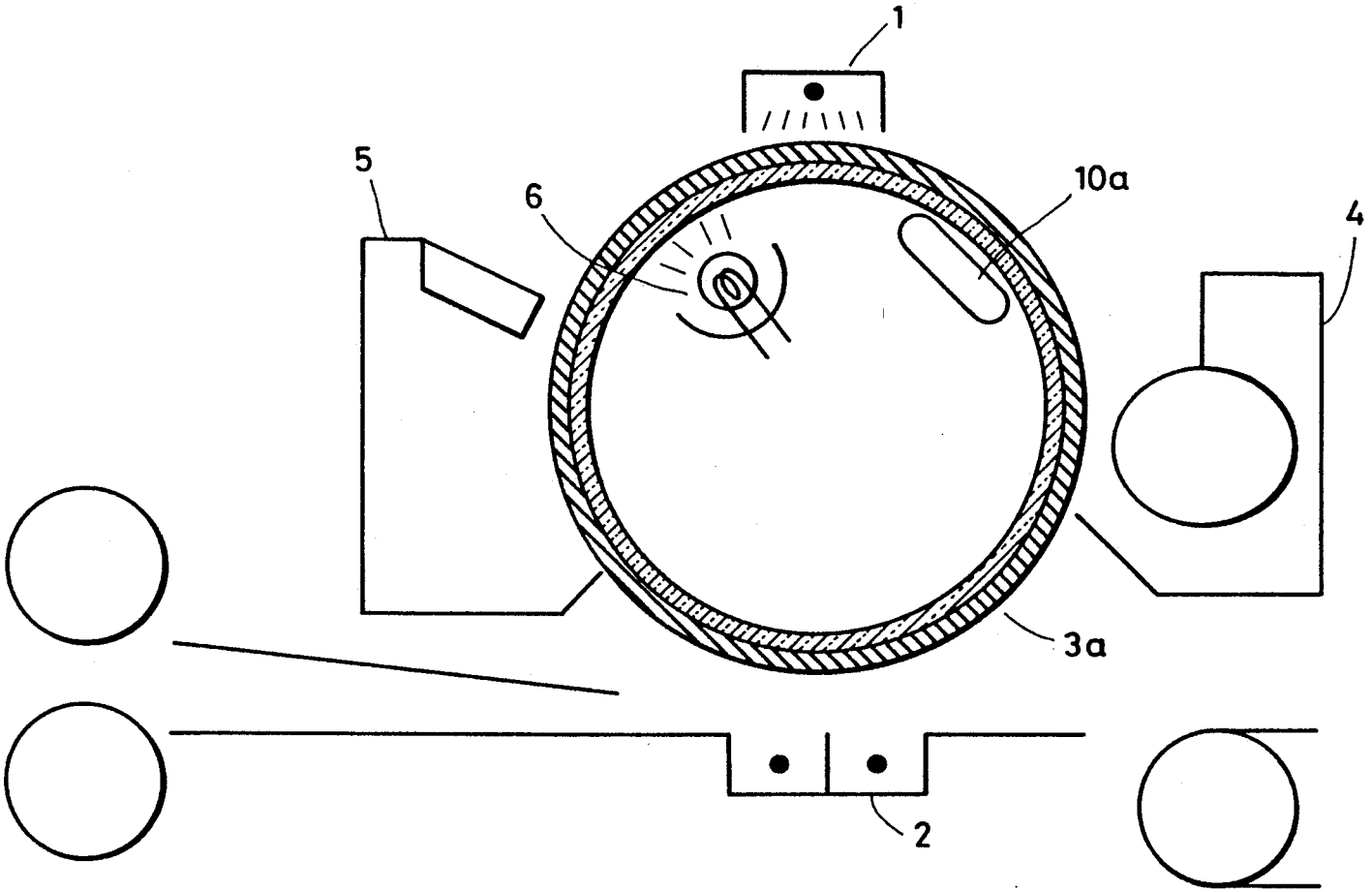
FIG. 4 is a sectional view of an electrophotographic apparatus employing a cylindrical light transmissive carrier and a light emitting diode ("LED") array as the light source.

The electrophotographic photosensitive members of the present invention are used in, for example, electrophotographic apparatuses as shown in FIGS. 1, 2 and 4. Each of these apparatuses can be used as a printer of a facsimile machine. In such a case, the image exposure is conducted for the purpose of printing the received data. FIG. 3 is a block diagram of a facsimile system incorporating this type of electrophotographic apparatus as the printer.

Referring to FIG. 3, a controller 11 is capable of controlling an image reading portion 20 and a printer 19. The controller 11, in turn, is under the control of a CPU 17. The data from the image reading portion 20 is transmitted to another station through a transmission circuit 13. Data received from the other station is delivered to the printer 19 through a receiving circuit 12. An image memory 16 stores image data representing a picture being processes by CPU 17. A printer controller 18 controls the printer 19. Numeral 14 denotes a telephone.

Image data received from a remote terminal through a circuit 15 is demodulated by the receiving circuit 12 and is decoded by the CPU 17, and the decoded data are successively stored in the image memory 16. When image data corresponding to at least one page is stored in the image memory 16, an operation is conducted to record the picture data of this page. A CPU 17 reads the image data of one page from the memory 16 and delivers the decoded image data of one page to the printer controller 18. Upon receipt of the image data of one page from the CPU 17, the printer controller 18 controls the printer 19 so as to record the image data of this page. During the recording of the image data by the printer 19, the CPU 17 receives the data corresponding to the image of the next page.

In a first embodiment, shown in FIG. 1, the printer controller 18 controls the modulation of the laser 7 light source to produce a variation in intensity of the light reaching the light transmission carrier 3 according to the image data representing the picture. In a second embodiment, shown in FIG. 2, the printer controller 18 controls the modulation of light emitting diode array 10 to produce a variation in intensity of light reaching the transmission carrier 3 for each element of the array according to image data representing the picture. It is, of course, recognized that at the various stages of data transfer, the data maybe encoded in various ways, so that it is obvious that the data need only be raster-decoded to modulate the individual light source or sources.

Thus, the operation for receiving image data and the operation for recording preciously received data may be conducted simultaneously.

EXAMPLE 1

A PET (polyethylene terephthalate) film 100 cm long, 25 cm wide and 25 μm thick was ground on one of its two major surfaces with a lapping film (commercial name of a film-type grounding material produced by Sumitomo 3M), such that both the maximum surface coarseness and the mean coarseness ($R_z$) fall within the ranges of 0.5 to 1.0 μm.

Then, an Al film was formed by vacuum evaporation on the coarsened surface of the PET sheet so as to complete a carrier. Meanwhile, a coating solution was prepared by mixing and dispersing the following materials for 6 hours within a ball mill: 10 wt. parts of titanyl oxaphthalocyanine, 10 wt. parts of polyvinyl butyral (butyralation degree 68%, number mean molecular weight 20,000) and 50 wt parts of cyclohexanone. This coating solution was applied to the conductive layer of the carrier by means of a Meyer bar, thereby forming a charge generating layer having a thickness of 1.0 μm after drying.

Then a solution was prepared by mixing 7 g. of a charge transporting substance having the below structure with 17 g. of a polycarbonate resin (commercial name PANLITE K-1300, produced by Teijin Kasei K.K.

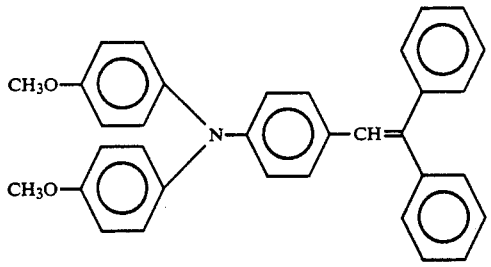

The mixture was dissolved and blended in a solvent formed by mixing 35 g. of THF (tetrahydrofuran) and 35 g. of chlorobenzene. This solution was applied by a Meyer bar on the above-mentioned charge generating layer, whereby an electrophotographic photosensitive member was completed with a laminated type photosensitive layer of 16 μm after drying.

It will be appreciated that in another embodiment of the present invention, a laser light source is located either inside or outside the cylindrical photosensitive member. Light is optically directed to pass through the carrier to be incident on the photosensitive layer in order to record a latent image. A fixed planar mirror can be oriented so that the reflective face is directed toward the area of the drum to be exposed with one end of the mirror near the longitudinal axis of the cylinder and the other inclined, and offset radially from the axis. A relatively small rotating mirror may be located outside the cylinder and near its axis, which scans the laser light source onto the inclined mirror, and reflects the light through the light transmissive cylindrical carrier to expose the photosensitive layer.

Both ends of this photosensitive member sheet were connected to each other to form an endless closed loop of sheet and this loop was mounted on the electrophotographic apparatus shown in FIG. 1.

Referring to FIG. 1, the electrophotographic apparatus has a corona charger 1 capable of performing a corona discharge of −6kV so as to charge the endless loop of the photosensitive member 3. The apparatus also has a polygon mirror 8 through which the photosensitive member 3 is scanned from the space inside the loop of the photosensitive member 3 with a laser light of a wavelength of 780 nm emitted from a semiconductor laser 7. Accordingly, photosensitive member 3 is exposed to light from the space inside the loop of the photosensitive member 3, i.e., through the carrier of the photosensitive member 3. Then, steps such as development of the image by a developing device 4, image transfer by a transfer charger 2 and cleaning by a cleaner 5 are conducted, followed by a charge-removing exposure employing a blanket exposure which also is conducted through the carrier.

Referring to FIG. 4, the electrophotographic apparatus has a corona charger capable of performing a corona discharge of −6 KV so as to charge a photosensitive layer of the light transmissive cylindrical drum member 3*a*. The apparatus also has an LED array light source 10*a*, which, for example, emits a light of a wavelength around 680 nm. The light from the LED array light source 10*a* passes through the cylindrical light transmissive carrier 3*a* and illuminates the photosensitive layer. Then, steps such as development of the image by a developing device 4, image transfer by a transfer charger 2 and cleaning by a cleaner 5 are conducted, followed by a charge removing exposure by a charge removing blanket illumination source 6, which is conducted from the inner surface.

Figure 5:
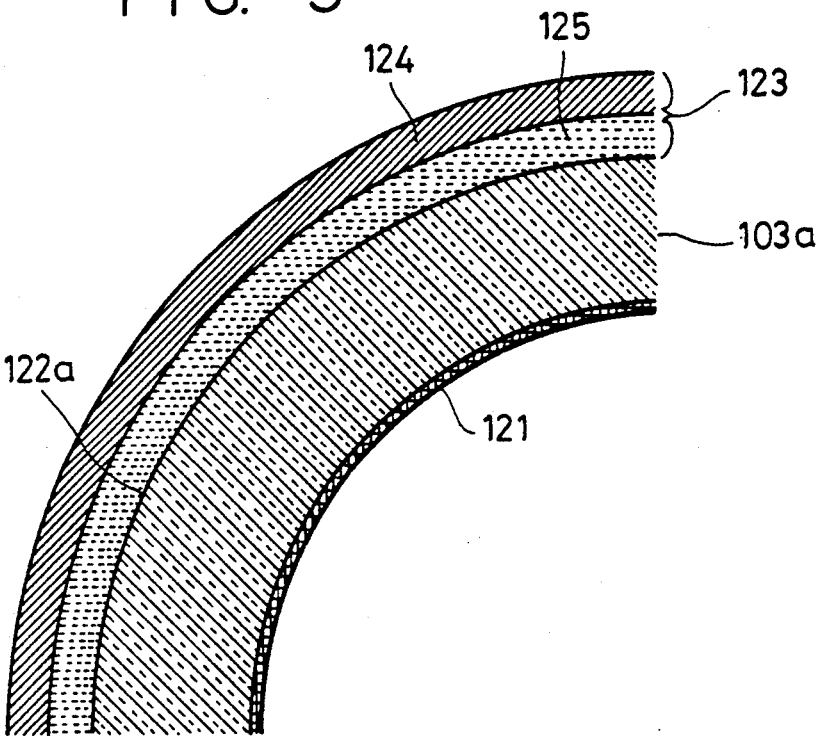
FIG. 5 is a sectional view of a light transmissive carrier with a roughened inner surface and a laminate type photosensitive layer on its outer surface.

Referring to FIG. 5, the light-transmissive carrier 103*a* has a surface roughness of its inner surface 121 of about 0.3 μm to 4.0 μm, and has a photosensitive layer 123 on its outer surface 122*a*, composed of a charge transporting layer 124 laminated to a charge generating layer 125.

Figure 6:
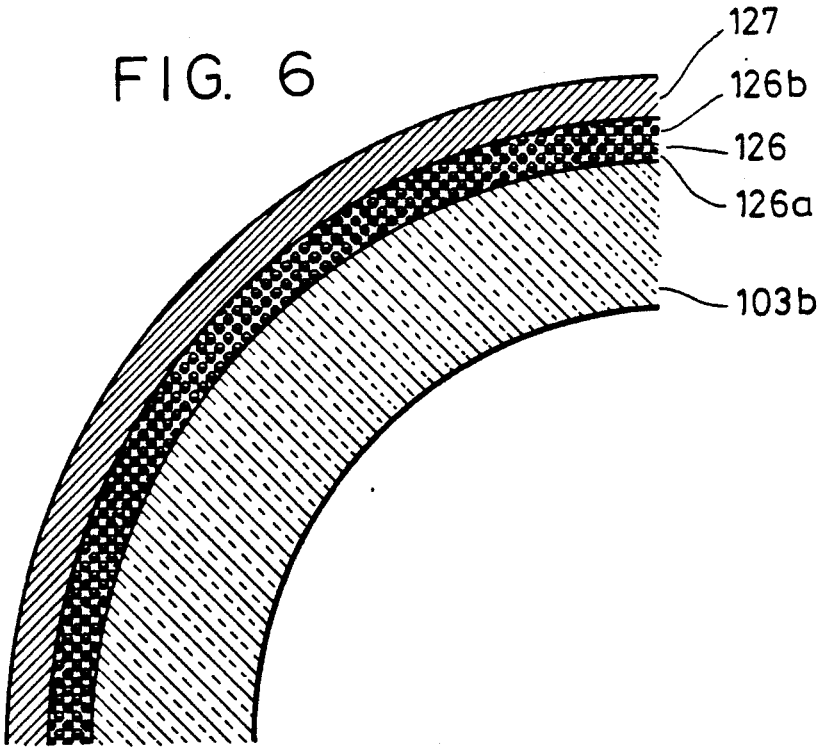
FIG. 6 is a sectional view of a light transmissive carrier with a particulate filled light-transmissive layer between the carrier and the photosensitive layer.

Referring to FIG. 6, the light-transmissive carrier 103*b* has a light-transmissive layer 126 containing fine particles 126*b* in a resin matrix 126*a*, formed on its outer surface 122*b*. A photosensitive layer 127 is formed on top of the light-transmissive layer 126.

Image development was conducted in a so-called reversal developing method using a negative toner.

Test printing was conducted with this apparatus so as to form images of alphabet characters, solid black, halftone and solid white pattern of 5 mm square. A test also was conducted by producing 1,000 continuous copies so as to examine durability of the photosensitive member. The results of these tests are shown in Table 1.

EXAMPLES 2 to 4

Photosensitive members were produced by the same process as Example 1, except that the maximum and mean coarseness ($R_z$) of the carrier surfaces were not less than 0.3 μm and not more than 0.8 μm (Example 2), not less than 0.5 μm and not more than 1.2 μm (Example 3) and not less than 2.0 μm and not more than 3.6 μm (Example 4), and were subjected to a printing test conducted under the same conditions as Example 1. The results are also shown in Table 1.

COMPARISON EXAMPLES 1 and 2

Photosensitive members were produced by the same process as Example 1, except that both the maximum and mean roughness ($R_z$) of the carrier surfaces were not more than 0.1 μm (Comparison Example 1) and not less than 4.2 μm (Comparison Example 2), and were subjected to a printing test conducted under the same conditions as Example 1. The results are also shown in Table 1.

EXAMPLE 5

A photosensitive member was produced by the same process as Example 1, except that the conductive layer and the photosensitive layer were formed on the opposite side of the carrier to the coarsened surface, and was subjected to a printing test conducted under the same conditions as Example 1. The results are also shown in Table 1.

EXAMPLE 6

A photosensitive member was produced by the same process as Example 1, except that both the maximum and mean roughness of both surfaces of the carrier were not less than 0.3 μm and nor more than 0.8 μm, and was subjected to a printing test conducted under the same conditions as Example 1. The results are also shown in Table 1.

EXAMPLE 7

A printing test was conducted with the same photosensitive members as Example 1, by using the electrophotographic apparatus as shown in FIG. 2. The results also are shown in Table 1. The electrophotographic apparatus shown in FIG. 2 was substantially the same as the apparatus of FIG. 1 except that an LED array 10 for emitting light of 680 nm wavelength is used as the light source for the image exposure.

EXAMPLE 8

A photosensitive member was produced by the same process as Example 1, except that the conductive layer on the carrier was formed by evaporation deposition of ITO. The results also are shown in Table 1.

TABLE 1

| | Roughness of carrier surface (μm) | | Type of picture | | | | |
|---|---|---|---|---|---|---|---|
| Example | Max. | Mean | Alpha-bet | Solid black | Half-tone | Solid white | 1000th copy |
| Example 1 | 1.0 | 0.5 | ○ | ○ | ○ | ○ | ○ |
| Example 2 | 0.8 | 0.3 | ○ | ○ | ○ | ○ | ○ |
| Example 3 | 1.2 | 0.5 | ○ | ○ | ○ | ○ | ○ |
| Example 4 | 3.6 | 2.0 | ○ | ○ | ○ | ○○ | ○ |
| Example 5 | 1.0 | 0.5 | ○ | ○ | ○ | ○ | ○ |
| Example 6 | 0.8 | 0.3 | ○ | ○ | ○ | ○ | ○ |
| Example 7 | 1.0 | 1.5 | ○ | ○ | ○ | ○ | ○ |
| Example 8 | 1.0 | 1.5 | ○ | ○ | ○ | ○ | ○ |
| Comparison example 1 | 0.1 | 0.05 | ○ | x(1) | x(1) | ○ | x(1) |
| Comparison example 2 | 4.2 | 2.2 | x(2) | ○ | x(3) | x(3), (4) | x(2), (3), (4) |

(1)Interference fringe; (2)Black spots in background; (3)Fog, ○: Good

EXAMPLES 9 to 13 and COMPARISON EXAMPLES 3 to 6

Al was formed by evaporation deposition on one side of a PET sheet of 100 cm. long, 2 cm. wide and 100 μm thick, thus forming a light-transmissive conductive carrier. A coating material liquid for forming a light-transmissive layer was formed by dissolving, in 92 parts of methanol, 2 parts of copolymer nylon resin (mean molecular weight 14,000) and 6 parts of N-methoxy methylated 6-nylon resin (mean molecular weight 11,000). A plurality of types of coating solution for forming the light-transmissive layer were prepared by adding various amounts of polymethylsylsesquioxane of a mean particle size of 2 μm to the resin component of the above-mentioned material liquid in amounts such that the polymethylsylsesquioxane contents were 10 wt. % (Example 9), 20 wt. % (Example 10), 50 wt. % (Example 11), 60 wt. % (Example 12) and 80 wt. % (Example 13).

For the purpose of comparison, coating liquids were prepared to have the polymethylsylsesquioxane contents of 5 wt. %, 85 wt. % and 90 wt. %, and were used in the production of photosensitive members of Comparison Examples 4 to 6. A photosensitive member of Comparison Example No. 3 was formed by using a coating liquid which did not contain polymethylsylsesquioxane.

The light-transmissive coating liquids thus formed were applied by dipping onto the conductive surfaces of the pieces of the above-described carrier and the coated carrier pieces were dried at 100° C. for 40 minutes, whereby a light-transmissive layer having a film thickness of 3.0 μm was formed on the carriers.

Then, a dispersion liquid for forming a charge generating layer was prepared. This was conducted by blending and dispersing, in a sand mill charged with glass beads of 1 mm dia. for 12 hours, a mixture composed of 3 wt. parts of disazo pigment expressed by the following formula, 2 wt. parts of polyvinyl benzal (degree of benzalation 80%, mean molecular weight 11,000) and 35 parts of cyclohexanone.

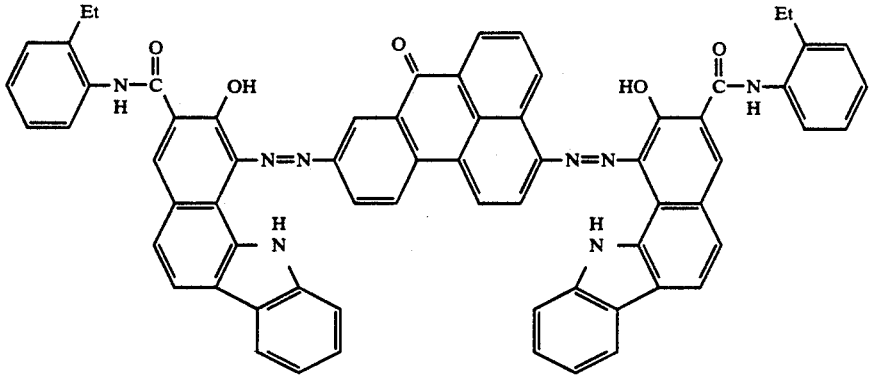

Et: $C_2H_5$—

Then, 60 wt. parts of methyl ethyl ketone (MEK) was added to the dispersion, thus forming the dispersion liquid for the charge generating layer. This dispersion liquid was applied by dipping to the light-transmissive layer on each carrier, followed by a 20-minute drying at 80° C., whereby a charge generating layer of 0.2 μm was formed on each carrier.

Meanwhile, 10 wt. parts of a styryl compound having a composition shown, by the following formula and 10 wt. parts of polycarbonate (mean molecular weight 46,000) were dissolved in a mixed solvent composed of 40 parts of dichloromethane and 20 parts of monochlorobenzene, and this solution was applied by dipping to the above-mentioned charge generating layer of each carrier, followed by a 60-minute drying at 120° C., whereby a charge transporting/transporting layer 25 μm thick was formed.

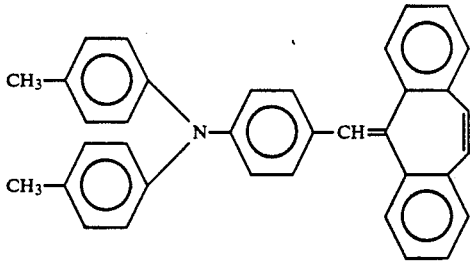

Both ends of each photosensitive member thus formed were connected to form a loop such that the photosensitive layer is disposed on the outer side of the loop, whereby an endless sheet-like photosensitive member was formed. Each of the thus formed photosensitive members was mounted on the electrophotographic apparatus shown in FIG. 1.

Referring to FIG. 1, the electrophotographic apparatus has a corona charger 1 capable of performing a corona discharge of −6kv so as to charge the endless loop of the photosensitive member 3.

The apparatus also has a semiconductor laser and a rotating octagonal mirror for scanning the photosensitive member with a laser light of 780 nm wavelength through the carrier of the photosensitive member, from the space inside the loop of the photosensitive member, so that the photosensitive member 3 is exposed to light from the space inside the loop of the photosensitive member. Then, steps such as development of the image by a developing device, image transfer by a transfer charger and cleaning by a cleaner are conducted, followed by a charge-removing exposure which also is conducted through the carrier.

The development was conducted in a so-called reversal developing method using a negative toner.

Test printing was conducted with this apparatus so as to form images of alphabet characters, solid black, halftone and solid white pattern of 5 mm square. A test also was conducted by producing 1,000 continuous copies so as to examine the durability of the photosensitive member.

In each of Examples 9 to 13, the photosensitive member of the invention showed good quality of picture for each of the alphabet characters, and solid black, halftone and solid white pictures in the beginning period of the test operation. The picture quality was not substantially degraded even after continuous production of 1000 copies, thus proving high stability of the image.

On the other hand, Comparison Examples 3 and 4, which contained 0 weight % and 5 weight % polymethylsylsesquioxane, respectively, exhibited interference fringes, thus providing defective pictures from the beginning of the test operation.

Image defects such as blurred images of alphabet characters, irregularity of halftone density and insufficient picture density were found when the test was conducted with Comparison Examples 5 and 6 of photosensitive members, which contained 85 wt. % and 90 wt. % of polymethylsylsesquioxane.

EXAMPLES 14 to 18 and COMPARISON EXAMPLES 7 to 9

A coating material solution for forming the light-transmissive layer was prepared by dissolving, in 80 parts of methyl ethyl ketone, a mixture containing 1 wt part of hexamethylene diisocyanate, 13 wt. % parts of poly(oxypropylene)glycol (hydroxide group 25 mg. KOH/g), 6 wt parts of copoly(oxypropylene)(oxyethylene)triol (hydroxide group 51 mg KOH/g) and 0.001 wt. part of dibutyltindilaurate. Acrylic resin particles of a mean particle size 3 μm were added in amounts of 10 wt. %, 20 wt. %, 50 wt. %, 60 wt. % and 80 wt. %, respectively, per solid content of the above-mentioned solution, and dispersed in the solution to form coating solutions for light-transmissive layers of Examples 14 to 18 of the photosensitive member.

Also coating solutions were prepared by adding, respectively, 5 wt. % and 90 wt. % based on solid content of the acrylic resin particles to the above-mentioned coating material solution. These coating solutions were used for forming light-transmitting layers in Comparison Examples 8 and 9. At the same time, a coating solution containing no acrylic resin particles was prepared and used as the material of the light-transmissive layer of Comparison Example 7 of the photosensitive member.

These coating solutions were applied by dipping to the surfaces of the conductive layers described above, followed by a 60-minute drying at 140° C., whereby light-transmissive layers 1.5 μm thick were formed on the conductive layers.

Then, a charge generating layer and a charge transporting layer were formed by the same process as in Example 9 on the light-transmissive layer, whereby Examples 14 to 18 of the photosensitive member of the invention and Comparison Examples 7 to 9 were formed. These Examples and Comparison Examples were then tested under the same conditions as Example 9, using the electrophotographic apparatus shown in FIG. 1.

Examples 14 to 18 of the photosensitive member of the invention showed superior qualities of pictures of alphabet characters, solid black, halftone and solid white. The picture qualities were stable and no substantial degradation was observed even after continuous production of 1000 copies.

In contrast, Comparison Examples 7 and 8, which contained 0 weight % and 5 weight % acrylic resin particles, respectively, permitted generation of interference fringes from the beginning, thus causing defects in the produced images.

On the other hand, Comparison Example 9, which contained acrylic resin particles in amount of 90 wt. %, undesirably showed image defects such as blur of the alphabet characters, irregularity of halftone density and insufficient density of the image.

What is claimed is:

1. An electrophotographic apparatus comprising:
(a) an electrophotographic photosensitive member having a light-transmissive carrier at least one surface of which has a maximum roughness value ranging from about 0.3 μm to 4.0 μm and a mean roughness value ranging from about 0.3 μm to 4.0 μm, and a photosensitive layer formed on one of said major surfaces of said carrier;
(b) a monochromatic light source adjacent the light-transmissive carrier side of said electrophotographic photosensitive member for illuminating the photosensitive layer to form an electrostatic latent image thereon; whereby monochromatic light passes through the light transmissive carrier to illuminate the photosensitive layer;
(c) means for developing the electrostatic latent image formed; and
(d) means for transferring the developed image.

2. An electrophotographic apparatus according to claim 1, wherein said light-transmissive carrier is formed from a light-transmissive resin.

3. An electrophotographic apparatus according to claim 1, wherein the surface of said carrier adjacent said photosensitive layer has a maximum roughness value ranging from about 0.3 μm to 4.0 μm and a mean roughness value ranging from about 0.3 μm to 4.0 μm.

4. An electrophotographic apparatus according to claim 1, wherein said photosensitive layer comprises a charge generating layer laminated to a charge transporting layer.

5. An electrophotographic apparatus according to claim 4, wherein said charge generating layer is disposed between said light-transmissive carrier and said charge transporting layer.

6. An electrophotographic apparatus according to claim 1, wherein said monochromatic light source is a laser.

7. An electrophotographic apparatus according to claim 1, wherein said monochromatic light source is a light emitting diode array.

8. An electrophotographic apparatus according to claim 1, wherein said light-transmissive carrier is a light-transmissive cylindrical carrier.

9. An electrophotographic apparatus according to claim 8, wherein said photosensitive layer has a charge generating layer laminated to a charge transporting layer, wherein said charge generating layer is disposed between said light-transmissive cylindrical carrier and said charge transporting layer.

10. An electrophotographic apparatus according to claim 1, wherein said light-transmissive carrier is a light-transmissive looped endless sheet carrier.

11. An electrophotographic apparatus according to claim 10, wherein said photosensitive layer has a charge generating layer laminated to a charge transporting layer, wherein said charge generating layer is disposed between said light-transmissive looped endless sheet carrier and said charge transporting layer.

12. An electrophotographic apparatus comprising:
(a) an electrophotographic photosensitive member having a light-transmissive carrier, a photosensitive layer, and a light-transmissive layer formed between said light-transmissive carrier and said photosensitive layer, said light-transmissive layer containing fine particles capable of randomly scattering monochromatic light to prevent formation of interference fringes on said photosensitive layer;
(b) a monochromatic light source adjacent the light-transmissive carrier side of said electrophotographic photosensitive member for illuminating the photosensitive layer to form an electrostatic latent image thereon; whereby monochromatic light passes through the light transmissive carrier and the light-transmissive layer to illuminate the photosensitive layer;
(c) means for developing the electrostatic latent image formed; and
(d) means for transferring the developed image.

13. An electrophotographic apparatus according to claim 12, wherein said light-transmissive carrier is formed from a light-transmissive resin.

14. An electrophotographic apparatus according to claim 12, wherein said fine particles have a mean particle size not greater than 10 μm.

15. An electrophotographic apparatus according to claim 12, wherein said fine particles of said light-transmissive layer are dispersed in a binder resin, and the content of said fine matters in said light-transmissive layer ranges between 10 and 80 wt. %.

16. An electrophotographic apparatus according to claim 12, wherein said photosensitive layer comprises a charge generating layer laminated to a charge transporting layer.

17. An electrophotographic apparatus according to claim 16, wherein said charge generating layer is disposed between said light-transmissive carrier and said charge transporting layer.

18. An electrophotographic apparatus according to claim 12, wherein said fine particles have a mean particle size not greater than 10 μm, and said photosensitive layer comprises a charge generating layer laminated to a charge transporting layer.

19. An electrophotographic apparatus according to claim 12, wherein said light-transmissive carrier is a light transmissive cylindrical carrier.

20. An electrophotographic apparatus according to claim 12, wherein said light-transmissive carrier is a light transmissive looped endless sheet carrier.

21. An electrophotographic apparatus according to claim 12, wherein said monochromatic light source is a laser light source.

22. An electrophotographic apparatus according to claim 12, wherein said monochromatic light source is a light emitting diode array light source.

* * * * *